United States Patent [19]

Arisato

[11] Patent Number: 4,972,790

[45] Date of Patent: Nov. 27, 1990

[54] BOOM FOR BOARDSAILING

[75] Inventor: Toshiyuki Arisato, Tokyo, Japan

[73] Assignee: Somar Corporation, Tokyo, Japan

[21] Appl. No.: 386,400

[22] Filed: Jul. 28, 1989

[30] Foreign Application Priority Data

Jul. 30, 1988 [JP] Japan ..... 63-190855

[51] Int. Cl.[5] ..... B63B 35/00; B63H 9/10; F16L 11/08

[52] U.S. Cl. ..... 114/97; 138/130

[58] Field of Search ..... 114/97–99, 114/89, 90; 138/125, 130

[56] References Cited

U.S. PATENT DOCUMENTS

| | | | |
|---|---|---|---|
| 4,562,787 | 1/1986 | Adamek et al. | 114/97 |
| 4,605,385 | 8/1986 | Pück et al. | 138/130 |
| 4,640,211 | 2/1987 | Namur | 114/97 |
| 4,674,428 | 6/1987 | Weber et al. | 114/98 |
| 4,693,281 | 9/1987 | Creedon | 138/130 |
| 4,700,647 | 10/1987 | Pabsch | 114/89 |
| 4,867,091 | 9/1989 | Arisato et al. | 114/97 |

FOREIGN PATENT DOCUMENTS

| | | | |
|---|---|---|---|
| 3633837 | 10/1987 | Fed. Rep. of Germany | 114/97 |

*Primary Examiner*—David H. Brown

*Attorney, Agent, or Firm*—Sughrue, Mion, Zinn, Macpeak & Seas

[57] ABSTRACT

A boom for a boardsailing is formed of two bodies, intermediate pipes, end pipes, a front coupler and a rear coupler. The bodies and pipes are non-metallic synthetic resin pipe reinforced by fiber layers, including a synthetic fiber layer and at least one carbon fiber layer. The portions of said bodies, intermediate pipes and end pipes which are used for interconnecting with the couplers and with each other are further reinforced by a reinforcing synthetic resin layer which is reinforced by a reinforcing fiber layer. The reinforcing fiber layer includes fine fibers oriented in at least two mutually different directions and having diameters of 20 μm or less.

6 Claims, 2 Drawing Sheets

BOOM FOR BOARDSAILING

BACKGROUND OF THE INVENTION

The present invention relates to a boom for a boardsailing.

A conventional boardsailing includes a mast attached to the body of the board by a universal joint, a boom attached to the halfway portion of the mast, and a sail attached to the mast and the boom and spread along them so that the sail can be manipulated. The boom is made of two bodies curved outward away from each other and connected to each other at both ends of the bodies so that the boom has an endless form. One end of each of the bodies of the boom is fitted in a coupler for the bodies, and pins provided on the body are engaged in optional ones of the holes of the coupler, so as to connect the body and the coupler to each other and set the boom at a desired length in accordance with the size of the sail, which is interchangeable depending on the strength of the wind on the sail. The boom is made of an aluminum alloy.

A boom made of an aluminum pipe reinforced by resin layers provided on the inside and outside surfaces of the pipe and reinforced by carbon fibers was developed in order to reduce the weight of the conventional boom for boardsailing without decreasing the strength thereof, as disclosed in the Japanese Utility Model Application (OPI) No. 13396/84 (the term "OPI" as used herein means an "unexamined published application"). However, it is desirable to reduce the weight of the boom even further to enhance the steering property of the boom. The enhancement can be achieved making the entire body of a carbon-fiber-reinforced resin or the like rather than aluminum. However, since the bodies have pin holes or rivet holes at their front ends and engagement pin holes at the rear ends thereof, and these holes need to be located in mutually symmetric opposite positions on the diameters of the bodies, the strength of the portions of the bodies, which have the holes, is greatly decreased. This is a problem.

SUMMARY OF THE INVENTION

The present invention was made in order to solve the above-mentioned problem.

Accordingly, it is an object of the present invention to provide a boom for a boardsailing. The boom comprises tubular bodies, intermediate pipes and end pipes, which are connected together. The tubular bodies are connected at their front ends to a front coupler and at their rear ends to a rear coupler. The intermediate pipes are connected at the front ends thereof to the rear ends of the tubular bodies and connected to the rear ends thereof to the front ends of the end pipes whose rear ends are connected to the rear coupler. Each of the tubular bodies is made of a synthetic resin pipe which is reinforced by a carbon fiber layer, a glass fiber layer, both a carbon fiber layer and a synthetic fiber layer or the like. Each of the intermediate pipes and the end pipes is made of a synthetic resin pipe which is reinforced by a carbon fiber layer, a glass fiber layer, both a carbon fiber layer and a synthetic fiber layer or the like. The portions of the synthetic resin pipes, which have pin holes or rivet holes and engagement pin holes, include reinforcing synthetic resin layers which constitute the inside surfaces of the portions and reinforce the portions. Thus, the boom is not made of a metal pipe such as an aluminum pipe, which is likely to undergo an electrolytic corrosion, but the boom has a high mechanical strength and a low weight.

BRIEF DESCRIPTION OF THE DRAWINGS

FIG. 3 shows a sectional view of the tubular body of the boom; and.

DETAILED DESCRIPTION OF AN EXEMPLARY EMBODIMENT

An embodiment of the present invention is hereafter described in detail with reference to the drawings attached hereto.

Figure 1:
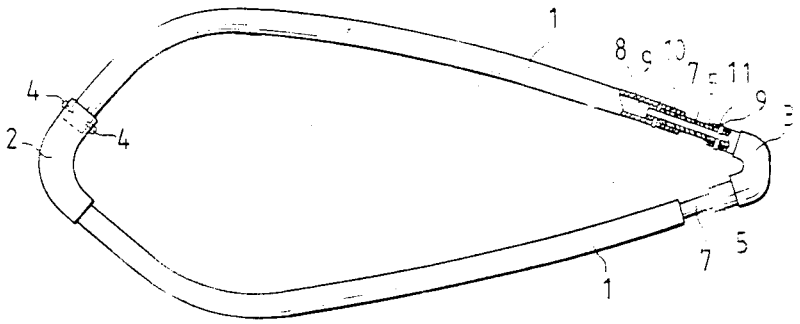
FIG. 1 shows a plan view of a boom for use with a boardsailing and is an embodiment of the present invention.
Figure 2:
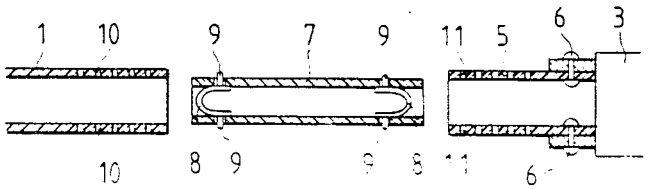
FIG. 2 shows an exploded sectional view of a part of the boom.

FIG. 1 shows a boom for a boardsailing. The boom includes two tubular bodies 1 curved outward away from each other as bows, a front coupler 2 and a rear coupler 3. The couplers are V-shaped and are connected to the front and rear ends of the tubular bodies in such a manner that the boom has an endless form. The tubular bodies 1 are fixedly connected to the front coupler 2 by rivets or pins 4 fitted in holes 4, (FIG. 3), but are connected to the rear coupler 3 by engagement pins 9 and engagement holes 10 and 11 so that the length of the boom can be changed. The boom also includes end pipes 5 which have the same diameter as the tubular bodies 1 and are secured to the ends of the rear coupler 3 by rivets 6. Intermediate pipes 7 are provided for insertion into the front portions of the end pipes and the rear portions of the tubular bodies 1. The engagement pins 9 are provided in the intermediate pipes 7 near both ends thereof and joined to springs 8, as shown in FIG. 2, so that the pins can be moved into and out of the pipes in the radial directions thereof. The engagement pins 9 are fitted in optional pairs of the engagement holes 10 of the tubular bodies 1 and optional pairs of the engagement holes 11 of the end pipes 5 to connect the intermediate pipes 7 to the bodies and the end pipes so as to set the length of the boom at an optional value.

Figure 3:
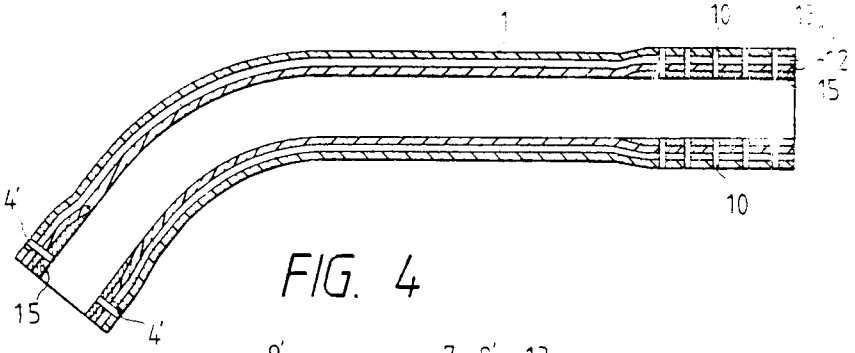

Each of the tubular bodies 1 is made of an integrated synthetic resin pipe reinforced by a synthetic fiber layer 14 and carbon fibers layers 12 and 13 provided on the inside and outside surfaces of the synthetic fiber layer, as shown in FIG. 3. The front and rear end portions of the tubular body 1, which have the holes 4, and the engagement holes 10, respectively, include reinforcing synthetic resin layers which are the innermost layers of the portions and are reinforced by reinforcing fiber layers 15, each having a prescribed thickness.

Figure 4:
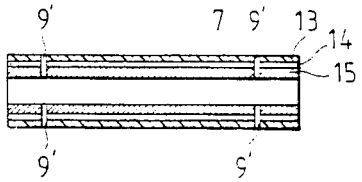
FIG. 4 shows a sectional view of the intermediate pipe of the boom.

Each of the end pipes 5 and the intermediate pipes 7 is made of an integrated synthetic resin pipe reinforced by a synthetic fiber layer 14 and a carbon fiber layer 13 overlaid on the outside surface of the synthetic fiber layer, as shown in FIG. 4. At least the portions of the end pipes 5 and the intermediate pipes 7, which have the engagement holes 11 and 9,, include reinforcing synthetic resin layers which are the innermost layers of the portions and are reinforced by reinforcing fiber layers 15, each having a prescribed thickness.

The carbon fiber layer 12 of each of the tubular bodies 1 is made of carbon fibers spirally wound around the axis of the tubular body in such a manner that the carbon fibers are oriented at an angle of 60° to 90°, usually at an angle slightly less than 90°, to the axis of the tubular body. The thickness of the carbon fiber layer 12 is 0.12 mm to 0.18 mm, preferably 0.14 mm to 0.16 mm.

The carbon fiber layer 13 of each of the tubular bodies 1, the end pipes 5 and the intermediate pipes 7 is made of carbon fibers interwoven with each other in such a manner that the fibers are oriented at an angle of 0° to 30°, usually at an angle of 20° or less, to the axis of the tubular body, the end pipe or the tubular pipe. The thickness of the carbon fiber layer 13 is 0.70 mm to 1.10 mm, preferably 0.80 mm to 0.95 mm.

The synthetic fiber layer 14 of each of the tubular bodies 1, the end pipes 5 and the intermediate pipes 7 is made of synthetic fibers such as nylon fibers, polyester fibers, aramid fibers and vinylon fibers, and is flexible enough as an interposed is material. The synthetic fibers are oriented at an angle of 30° or less to the axis of the tubular body 1, the end pipe 5 or the intermediate pipe 7. The synthetic fiber layer 14 may be made of such synthetic fibers interwoven with each other. The thickness of the layer 14 is 0.25 mm to 0.38 mm, preferably 0.29 mm to 0.32 mm. The layer 14 is much higher in flexibility and elasticity than the carbon fiber layers 12 and 13, and acts to prevent the boom from being destroyed by a force sharply applied thereto, thus enhancing the safety of the boom. Although the layer 14 is the intermediate layer of each of the tubular bodies 1, the end pipes 5 and the intermediate pipes 7, the layer may be provided as the outer or inner layer thereof.

Another fiber layer such as a fiberglass layer may be provided together with at least one of the carbon fiber layers 12 and 13.

The innermost layer of each of the portions of the tubular bodies 1, the intermediate pipes 7 and the end pipes 5, which have the holes 4' for the rivets 4 and the engagement holes 10, 9' and 11, is the reinforcing synthetic resin layer reinforced by the reinforcing fiber layer 15 made of fine fibers which have a diameter of 20 μm or less each and are subjected to winding, interweaving or the like, and oriented in at least two mutually different directions. If the fine fibers are oriented in two mutually different directions, one group of the fibers are oriented at an angle of 0°±20° to the axis of the tubular body 1, the intermediate pipe 7 or the end pipe 5, and the other group of the fibers are oriented at an angle of 90°±20° to the direction of the former group of the fibers. If the fine fibers are oriented in three mutually different directions, one group of the fibers are oriented at an angle of 0°±20° to the axis, another group of the fibers are oriented at an angle of 60°±20° to the direction of the former group of the fibers, and the other and last group of the fibers are oriented at an angle of 60°±20° to the direction of the second group of the fibers. Each of the fine fibers is 20 μm or less in diameter. If the diameter of the fine fibers were more than 20 μm, the mechanical strength of the reinforcing synthetic resin layer would not be high enough. The fine fibers are carbon fibers, fiberglass, a mixture of carbon fibers and fiberglass, aramid fibers or the like. The fine fibers are made into a woven fabric of bundled-fiber yarns, a nonwoven fabric such as Spandex, or the like. However, it is preferable that the reinforcing fiber layer 15 is a woven fabric such as a plain fabric and a multiple-axis fabric.

Since a strong force acts on each pin-engaged holed portion of the boom, the size of the portion needs to be prevented from being increased by the force to deform the portion. To prevent this from occurring, the fine fibers of the reinforcing fiber layer 15 are oriented in at least two mutually different directions and the volume of the fibers oriented in one of the directions is made ±30% less than that of the fibers oriented in the other direction but is preferably made nearly equal thereto. As a result, the portions of the tubular bodies 1, the intermediate pipes 7 and the end pipes 5, which have the holes 4', 10, 9' and 11, are provided with strength high enough to equally withstand both vertical and horizontal forces acting on each portion at each hole. The fine fibers of the reinforcing fiber layer 15 need to be disposed densely enough to be unlikely to move relative to each other, thus effectively preventing the size of the holed portion from being increased so as to deform the portion. As a result of studies made by the present inventors, it has turned out that the size of each of the portions having the holes 4', 10, 9' and 11 is effectively prevented from being increased so as to deform the portion during normal use, if the reinforcing synthetic resin layer reinforced by the reinforcing fiber layer 15 is made of a sheet manufactured by impregnating a synthetic resin in the reinforcing fiber layer such as a woven fabric in such a manner that the ratio t/n of the thickness t (mm) of the sheet to the number n or the orientations of the fibers of the reinforcing fiber layer is 0.12 or less. This condition is expressed as follows:

$$t/n \leqq 0.12 \quad \text{(I)}$$

The thickness t is expressed as follows:

$$t = W/(1{,}000 \cdot d \cdot Vf) \quad \text{(II)}$$

In the equation (II), W, d and Vf denote the unit weight ($g/m^2$) of the fiber of the reinforcing fiber layer 15, the density of the fibers thereof, and the ratio of the volume of the fibers to the unit volume of the sheet, respectively.

The relation (I) can therefore be transformed as follows:

$$t/n = \frac{W}{n \cdot 1{,}000 \cdot d \cdot Vf} \leqq 0.12 \quad \text{(III)}$$

The ratio Vf is generally 0.4 to 0.7, preferably 0.5 to 0.6. It is preferable that two, three or four woven fabrics, each of which satisfies the relation (I), are overlaid together to constitute the reinforcing fiber layer 15. The thickness of the layer 15 is 0.3 mm to 0.9 mm, preferably 0.5 mm to 0.7 mm.

When each of the tubular bodies 1 is to be manufactured, the reinforcing fiber layers 15 are first made on a flexible core whose surface is smooth. The fiber layers 12, 14 and 13 are then made on the fiber layers 15 so that a stratified fiber body is constituted. The fiber body is then impregnated with liquid thermosetting synthetic resin such as an epoxy resin and an unsaturated polyester resin. The fiber body is thereafter tightened with a film put on the body and easy to separate therefrom. The fiber body is then curved in accordance with the form of the boom, and heated in a setting furnace so that the resin impregnated in the body sets. After that, the core and the film are removed, thus manufacturing the tubular body 1. Various modifications may be made in manufacturing the tubular body 1. For one example, pre-pregs impregnated with the thermosetting synthetic resin in advance may be used as the fiber layers 15, 12, 14 and 13. For another example, the fiber layers 15, 12, 14 and 13 may be made according to the filament winding method by winding the fibers while impregnating them with the thermosetting synthetic resin. Besides, the stratification of the fiber layers 15, 12, 14 and 13 on the core is not confined to the above-mentioned order, but may be performed in other various orders. The synthetic fiber layer 14 may not be provided in each tubular body 1. Furthermore, a synthetic fiber layer and a carbon fiber layer may be additionally stratified on the carbon fiber layer 13.

When each of the intermediate pipes 7 is to be manufactured, the reinforcing fiber layer 15 is first made on a flexible core whose surface is smooth. The synthetic fiber layer 14 and the carbon fiber layer 13 are then made on the fiber layer 15 so that a stratified fiber body is constituted. The fiber body is impregnated with a liquid thermosetting synthetic resin such as an epoxy resin and an unsaturated polyester resin. The fiber body is then tightened with a film put on the body and easy to separate therefrom. The fiber body is then heated in a setting furnace so that the resin impregnated in the body sets. After that, the core and the film are removed, thus manufacturing the intermediate pipe 7.

Each of the end pipes 5 is manufactured in the same way as the intermediate pipes 7.

When the reinforcing synthetic resin layers of each of the tubular bodies 1, the end pipes 5 and the intermediate pipes 7, which are reinforced by the reinforcing fiber layers 15, are to be manufactured, reinforcing synthetic resin pipes reinforced by the reinforcing fiber layers may be manufactured in advance, fitted on the core and coated with the fiber layers 12, 14 and 13 or the fiber layers 14 and 13 to constitute the tubular body, the end pipe or the intermediate pipe.

Figure 5:
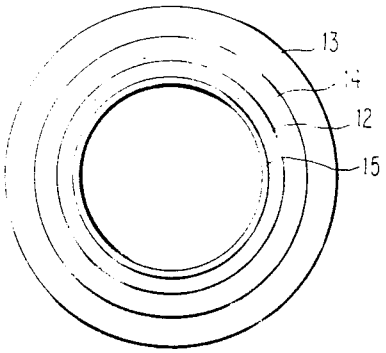
FIG. 5 shows a cross section of the boom at the run portion of the tabular body.
Figure 6:
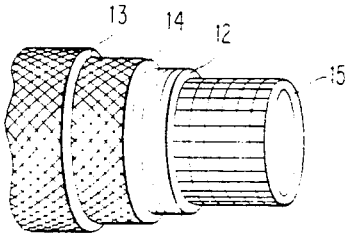
FIG. 6 shows a cut away view of the cross section of FIG. 5 including the oriented fibers in several layers.
Figure 7:
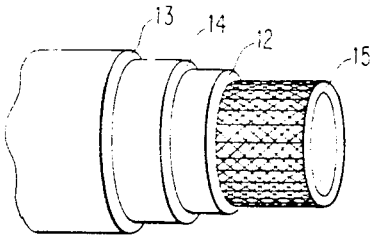
FIG. 7 shows an alternative orientation of fibers in the reinforcing fiber layer.

An illustration of a cross section of the boom with layer 12, 13, 14 and 15 is shown in FIG. 5. FIG. 6 is a cut away view of the cross section of the boom of FIG. 5, including the orientation of fibers in the several layers. FIG. 7 shows a cut away view as in FIG. 6, but illustrates a different orientation of reinforcing fibers in layer 15.

Each of the through holes 10, 11 and 9, of the portions of the tubular bodies 1, the end pipes 5 and the intermediate pipes 7, which have the reinforcing synthetic resin layers reinforced by the reinforcing fiber layers 15, has a diameter of about 6 mm to 7 mm usually. The distance between the adjacent holes 10, 11 and 9, is about 25 m to 50 mm. The holes 9' of the intermediate pipes 7 do not necessarily need to be through holes but may be blind holes in which the engagement pins 9 are fitted.

Concrete examples of the constructions of the reinforcing synthetic resin layers of the tubular bodies 1, the end pipes 5 and the intermediate pipes 7, which are reinforced by the reinforcing fiber layers 15, are described from now on. The innermost layer 15 of each tubular body 1 is made of four plain fabrics of fiberglass. Each of the fabrics is 0.18 mm in thickness when not yet impregnated with an epoxy resin, and is 205 g/m$^2$ in unit weight W and 2 in orientation number n. The angle between the directions of the orientation of the first and the second groups of the fibers of each of the fabrics is 90°. The glass fiber is 2.54 in specific gravity d and 9 μm in diameter. The ratio Vf of the volume of the fiberglass to that of the innermost layer 15 is 0.55. The ratio t/n of the thickness of the fabric to the orientation number is 0.0734. The first carbon fibers spirally wound at an angle of 90° to the axis of the tubular body. The thickness of the sheet is 0.15 mm. The diameter of each of the carbon fibers is 7 μm. The number of the carbon fibers is about 2,400,000 per meter. The synthetic fiber layer 14 of the tubular body 1 is made of a cloth of aramid fibers. The thickness of the cloth is 0.31 mm. The diameter of each of the aramid fibers is 12 μm. The second carbon fiber layer 13 of the tubular body 1 is made of three cloths of carbon fibers. The thickness of each of the cloths for the layer 13 is 0.31 mm. The diameter of each of the carbon fibers is 7 μm. The tubular body 1 is 1.4 to 1.6 g/cm$^3$ in density. The innermost layer 15 of each of the end pipes 5 and the intermediate pipes 7 has the same construction as that of each of the tubular bodies 1. The synthetic fiber layer 14 of each of the pipes 5 and 7 has the same construction as that of each of the tubular bodies 1. The carbon fiber layer 13 of each of the pipes 5 and 7 has the same construction as that of each of the tubular bodies 1.

Since the portions of the boom, which have the holes 4', 9', 10 and 11 for connecting the tubular bodies 1, the front coupler 2, the rear coupler 3, the intermediate pipes 7 and the end pipes 5 to each other, include the synthetic resin layers reinforced by the reinforcing fiber layers 15, as described above, the portions are strong enough as well as the other portions of the boom, which are made of synthetic resin pipes, each of which is composed of a synthetic-fiber-reinforced resin layer 14 and carbon-fiber-reinforced resin layers 12 and 13 sandwiching the layer 14 and different from each other in the direction of orientation of the fibers of the carbon-fiber-reinforced resin layers. The synthetic resin pipes are 1.4 to 1.6 g/cm$^3$ in density. Each of the synthetic resin pipes is 50% higher in flexural strength and 10% higher in compressive strength than a conventional aluminum alloy pipe, but weighs only about 50% of the latter. Therefore, the boom is strong and light enough. Since the boom is not made of a metallic material such as an aluminum pipe, the boom does not undergo an electrolytic corrosion.

What is claimed is:

1. A boom for a boardsailing, said boom comprising two bodies curved outwardly away from each other; a front coupler connected to the front ends of said bodies; a rear coupler; intermediate pipes; and end pipes; said intermediate pipes being connected to said bodies by pins engaged in holes provided in said intermediate pipes and said bodies and extending in the radial directions thereof; said end pipes being connected to said rear coupler; wherein each of said bodies and said pipes is a synthetic resin pipe reinforced by fiber layers; and the portions of said bodies and said intermediate pipes, which have said holes, include reinforcing synthetic resin layers, each of which constitutes the inside surface of said portion and is reinforced by a reinforcing fiber layer including fine fibers oriented in at least two mutually different directions and having diameters of 20 μm or less.

2. A boom according to the claim 1, wherein said fine fibers are fiberglass, carbon fibers or a mixture of fiberglass and carbon fibers.

3. A body for a boom for a boardsailing, said body being made of a synthetic resin pipe curved outwardly and reinforced by fiber layers and in which connecting holes are provided in said pipe near both the ends thereof and extend in the radial direction of said pipe; the portions of said pipe which have said holes including reinforcing synthetic resin layers, each of which constitutes the inside surface of said portion and is reinforced by a reinforcing fiber layer including fine fibers oriented in at least two mutually different-directions and having diameters of 20 μm or less.

4. An intermediate pipe for a boom for a boardsailing, said pipe being made of a straight synthetic resin pipe reinforced by fiber layers; connecting holes provided in said pipe near both ends thereof and extending in the radial direction of said pipe; the portions of said pipe which have said holes include reinforcing synthetic resin layers, each of which constitutes the inside surface of said portion and is reinforced by a reinforcing fiber layer including fine fibers oriented in at least two mutually different directions and having diameters of 20 μm or less.

5. An end pipe for a boom for a boardsailing, said pipe being made of a straight synthetic resin pipe reinforced by fiber layer; connecting holes provided in said pipe near both ends thereof and extending in the radial direction of said pipe; the portions of said pipe, which have said holes, include reinforcing synthetic resin layers, each of which constitutes the inside surface of said portion and is reinforced by a reinforcing fiber layer including fine fibers oriented in at least two mutually different directions and having diameters of 20 μm or less.

6. The invention in any of claims 1–5, wherein said synthetic resin pipe reinforced by fiber layers comprises a synthetic fiber layer and at least one carbon fiber layer; all said layers impregnated with resin.

* * * * *